US007382249B2

(12) United States Patent
Fancella

(10) Patent No.: US 7,382,249 B2
(45) Date of Patent: Jun. 3, 2008

(54) SECURITY MOTION SENSOR AND VIDEO RECORDING SYSTEM

(75) Inventor: Ron Fancella, Clay Center, KS (US)

(73) Assignee: Complete Surveillance Solutions, Salina, KS (US)

( * ) Notice: Subject to any disclaimer, the term of this patent is extended or adjusted under 35 U.S.C. 154(b) by 152 days.

(21) Appl. No.: 11/216,683

(22) Filed: Aug. 31, 2005

(65) Prior Publication Data

US 2007/0046462 A1 Mar. 1, 2007

(51) Int. Cl.
*G08B 13/00* (2006.01)

(52) U.S. Cl. ..... 340/541; 340/506; 340/517; 340/521; 340/531; 340/536.25; 340/539.26; 340/825.36; 348/152; 348/153; 348/154; 348/155

(58) Field of Classification Search ..... 340/541, 340/540, 506, 531, 539.1, 539.25, 539.26, 340/825.36, 825.49, 825.69, 517, 521, 539.22; 348/152, 153, 154, 155
See application file for complete search history.

(56) References Cited

U.S. PATENT DOCUMENTS 4,347,590 A * 8/1982 Heger et al. ..... 367/93
6,263,050 B1 * 7/2001 Akhteruzzaman et al. .... 379/45
6,441,731 B1 * 8/2002 Hess ..... 340/539.26
6,658,091 B1 * 12/2003 Naidoo et al. ..... 379/37
6,975,220 B1 * 12/2005 Foodman et al. ..... 340/531

* cited by examiner

*Primary Examiner*—Hung T. Nguyen
(74) *Attorney, Agent, or Firm*—Hovey Williams LLP

(57) ABSTRACT

A combined alarm and surveillance system integrates an existing alarm system (12) with an existing surveillance system (14) such that functions unique to each system are combined in a complementary manner. The existing alarm and surveillance systems are combined via an interface (16) comprising an array of electric relays (52,54,56,58,60,62). Each relay receives a signal from either the alarm system or the surveillance system and retransmits the signal to the other system in a form that is compatible with the receiving system. The alarm system is configured to communicate alarm status information to the surveillance system, and the surveillance system is configured to communicate control signals to the alarm system, such as an alarm system reset signal.

4 Claims, 2 Drawing Sheets

SECURITY MOTION SENSOR AND VIDEO RECORDING SYSTEM

BACKGROUND OF THE INVENTION

1. Field of the Invention

The present invention relates to alarm and surveillance systems. More particularly, the present invention involves a method and apparatus for integrating an existing alarm system with an existing surveillance system such that functions unique to each system are combined in a complementary manner.

2. Description of Prior Art

Surveillance systems including digital video cameras are known in the art and are commonly used in buildings or other sites where security measures require visual observation by a person, automatic motion detection, or video recording. Unfortunately, surveillance systems suffer from various problems and limitations that render them cumbersome or ineffective in certain situations.

For example, while a surveillance system can notify a user of motion detected by a camera, such systems are configured to provide these notifications according to a pre-determined schedule beginning at a certain time of day, such as 7:00 p.m., and ending at another time of day, such as 5:00 a.m. Thus, if an employee or other authorized person desires to work late and remain in the building beyond the scheduled activation time, the surveillance system administrator must be contacted to delay or entirely prevent activation of the notification function. It will be appreciated that where authorized activities frequently occur in the secured area after the scheduled activation time, such measures can become extremely burdensome and may be forgotten, resulting in false notifications.

Accordingly, there is a need for an improved surveillance system that overcomes these, and other, limitations of the prior art.

SUMMARY OF THE INVENTION

The present invention provides an improved alarm and surveillance system that does not suffer from the problems and limitations of the prior art. Particularly, the present invention provides a method and apparatus for integrating an existing alarm system with an existing surveillance system such that each system benefits from functionality of the other.

In a first embodiment, the invention is an integrated alarm and surveillance system, wherein the alarm system includes a user interface for enabling a user to arm and disarm the alarm system. The surveillance system includes a video camera for detecting motion in a field of view of the camera and an input port for receiving alarm system status information from the alarm system, wherein the status information includes whether the alarm system is armed. The surveillance system further includes a controller for communicating an electronic notification in response to detected motion if the alarm system is armed.

A second embodiment of the invention is a method of integrating the alarm and surveillance systems. The method comprises the step of connecting a first electric relay to the alarm system and to the surveillance system such that the relay receives a first signal from the alarm system and communicates the first signal to the surveillance system in a form compatible with the surveillance system. A second electric relay is connected to the alarm system and to the surveillance system such that the relay receives a second signal from the surveillance system and communicates the second signal to the alarm system in a form compatible with the alarm system. Finally, the surveillance system is configured to communicate an electronic notification in response to motion detected by a camera of the surveillance system if the first signal indicates that the alarm system is armed.

In a third embodiment of the invention, the alarm system includes a user interface for enabling a user to arm and disarm the alarm system and an input port for receiving an alarm system reset signal. The surveillance system includes a video camera for detecting motion in a field of view of the camera, an input port for receiving an alarm system status signal indicating whether the alarm system is armed, and a controller for generating an electronic notification in response to detected motion if the alarm system is armed, and for generating an alarm system reset signal.

The integrated alarm and surveillance system of this embodiment further comprises an interface, including a first electronic relay for receiving the status signal from the alarm system and communicating the status signal to the surveillance system in a form compatible with the input port of the surveillance system, and a second electronic relay for receiving the alarm system reset signal from the surveillance system and communicating the alarm system reset signal to the alarm system in a form compatible with the input port of the alarm system.

These and other important aspects of the present invention are described more fully in the detailed description below.

BRIEF DESCRIPTION OF THE DRAWINGS

An embodiment of the present invention is described in detail below with reference to the attached drawing figures, wherein.

DETAILED DESCRIPTION OF A PREFERRED EMBODIMENT

Figure 1:
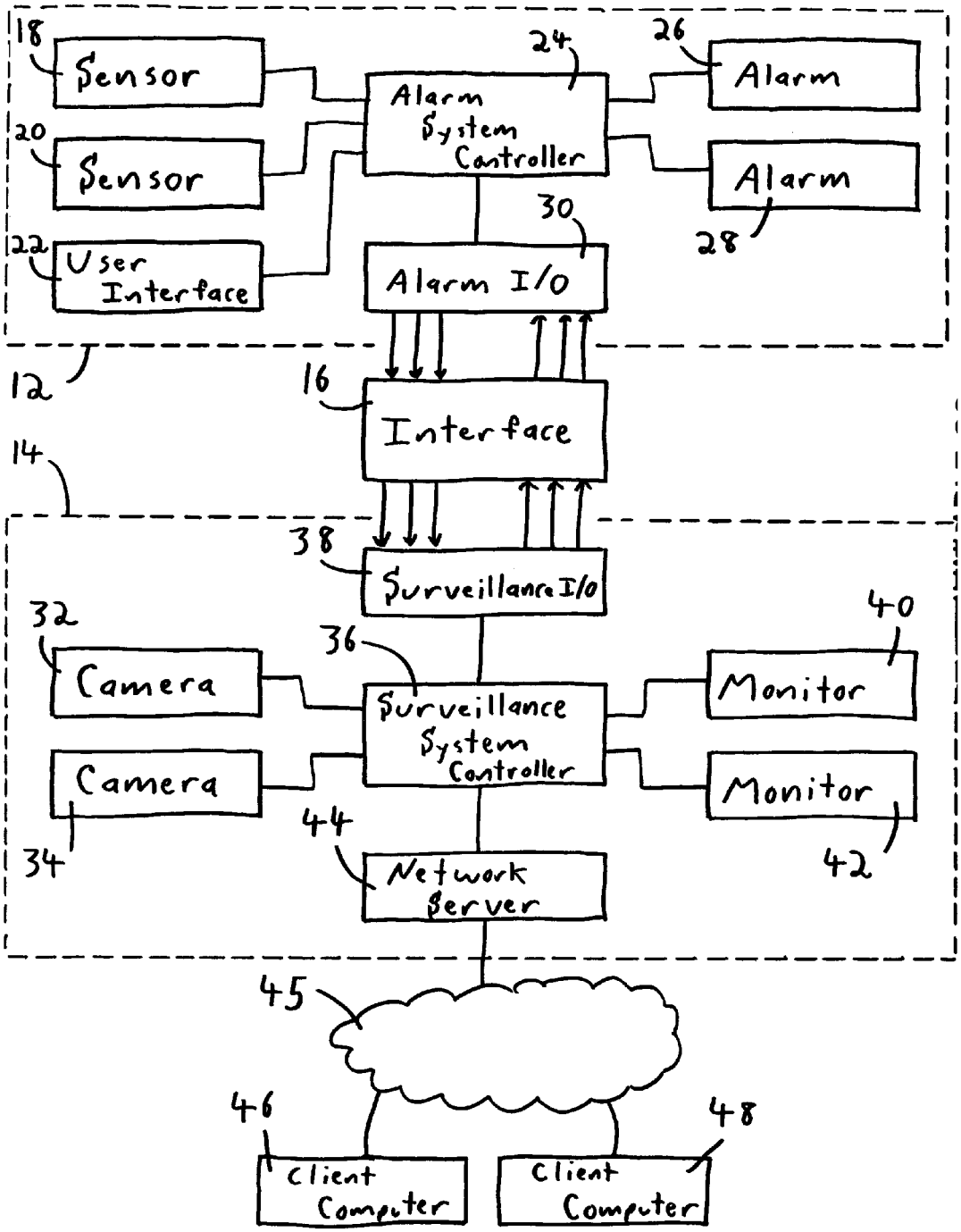
FIG. 1 is a schematic view of an integrated alarm and surveillance system constructed in accordance with a preferred embodiment of the present invention.

A preferred embodiment of an alarm and surveillance system incorporating the principles of the present teachings is illustrated in FIG. 1 and designated generally by the reference numeral 10. The alarm and surveillance system 10 broadly comprises an alarm system 12 and a surveillance system 14 interconnected by an interface 16. The interface 16 generally enables communications between the alarm system 12 and the surveillance system 14 so that, for example, users can control the surveillance system 14 via the alarm system 12 and vice versa.

The alarm system 12 detects disturbances in a building or other designated area and notifies one or more users of a disturbance. The alarm system 12 is substantially conventional and therefore will be described in general terms, with the understanding that the illustrated system 12 is exemplary in nature and that alternative systems are within the ambit of the present invention.

The alarm system 12 includes a plurality of sensors 18,20, a user interface 22, a controller 24, a plurality of alarms 26,28, and an input/output ("I/O") module 30. The sensors 18,20 generally detect physical disturbances and communicate information to the controller 24 concerning the disturbances. The sensors 18,20 are conventional alarm sensors and may detect, for example, infrared radiation, movement of doors or windows, breaking glass, changes in temperature, and so forth.

The user interface 22 enables a user to communicate with the controller 24 to control operation of the alarm system 12 and to receive information relating to the alarm system 12. A user may submit a user or authorization code, for example, to arm and disarm the alarm system 12, and the interface 22 may report a status of the alarm system 12 such as armed, disarmed, or triggered. The user interface 22 is substantially conventional and includes one or more specialized buttons, a keypad, a number pad, or a combination thereof. The interface 22 further includes one or more display elements, such as a liquid crystal display, a light-emitted diode, or both.

The alarm controller 24 communicates with the various other components of the alarm system 12 to receive information and to control the operation of the alarm system 12. The controller 24 preferably includes a digital processor, such as a general-application computer processor or programmable logic device, or a custom-made digital circuit, such as an application specific integrated circuit (ASIC). The controller 24 may comprise a single integrated circuit, or may comprise multiple integrated circuits and/or discrete electrical components. The controller 24 receives signals from the other components of the alarm system 12, digitally processes the signals, and communicates signals to the other components of the alarm system 12. Furthermore, the controller 24 may communicate with the other components of the alarm system 12 via wired connections, as illustrated, or may communicate with the other components via wireless links.

The alarms 26,28 generally notify one or more users that the alarm system 12 has detected a disturbance. The alarms 26,28 are conventional notification devices that produce an audible and/or visual response to the disturbance, such as a siren, flashing lights and so forth. Furthermore, the alarms 26,28 may communicate an alarm signal to an external system or device, or otherwise notify a predetermined person or entity that a disturbance has been detected.

The alarm input/output module 30 provides an electrical interface between the alarm controller 24 and one or more external electronic devices. The I/O module 30 may be, for example, a printed circuit board internal to the alarm system 12, a self-contained unit external to the alarm system 12, or a standard alarm panel. The I/O module 30 may communicate with an external device via a wired connection, a wireless connection, or a combination of wired and wireless connections.

The surveillance system 14 enables one or more users to observe areas or objects from one or more central and/or remote locations. The surveillance system 14 is substantially conventional and therefore will be described in general terms, with the understanding that the illustrated system 14 is exemplary in nature and that alternative systems are within the ambit of the present invention.

The surveillance system 14 includes a plurality of cameras 32,34, a surveillance system controller 36, a surveillance input/output ("I/O") module 38, a plurality of system monitors 40,42, and a network server computer 44. The network server computer 44 connects to a plurality of client computers 46,48 via a network communications system 45 to enable remote users to interact with the surveillance system 14, the alarm system 12, or both to quickly react to disturbances to detected by either system.

The cameras 32,34 are preferably digital video recording devices that continuously capture digital video data and communicate the video data to the surveillance system controller 36. The digital video data is stored on the network server computer 44 or another digital data repository (not shown) that may be internal or external to the surveillance system 14. The cameras 32,34 are installed at various locations in the building or other area to be monitored, such as in hallways, rooms, vaults, rooftops, external walls, and so forth.

The surveillance system controller 36 communicates with the other elements of the surveillance system 14 to receive information and control the operation of the system 14. The controller 36 preferably includes a digital processor, such as a general-application computer processor or programmable logic device, or a custom-made digital circuit, such as an application specific integrated circuit (ASIC). The controller 36 may comprise a single integrated circuit, or may comprise multiple integrated circuits and/or discrete electrical components. The controller 36 receives signals from the other components of the surveillance system 14, digitally processes the signals, and communicates signals to the other components of the surveillance system 14. Furthermore, the controller 36 may communicate with the various other components of the surveillance system 14 via wired connections, as illustrated in FIG. 1, or via wireless links.

The surveillance input/output module 38 provides an electrical interface between the surveillance controller 36 and external electronic devices. The I/O module 38 may be, for example, a printed circuit board internal to the surveillance system 14 or may be a self-contained unit external to the surveillance system 14. The I/O module 38 may communicate with an external device via a wired connection, a wireless connection, or a combination of wired and wireless connections.

The monitors 40,42 enable users to view the digital video generated by the cameras 32,34, and further allow users to control the surveillance system 14 by communicating control signals to the surveillance system controller 36. Via the monitors 40,42, for example, users can choose to view video from a first camera 32, a second camera 34, or both. The monitors 40,42 may include a cathode ray tube (CRT) display and a simple user interface, or the monitors 40,42 may be implemented in software and appear as a user interface on a computer display.

The surveillance system controller 36 communicates with the network server computer 44 to digitally communicate digital video data to, and receive control signals from, one or more remote locations, such as network client computers 46,48. Thus, users may receive digital video data generated by the cameras 32,34 via the client computers 46,46 which may be at a remote location. Users may also control the surveillance system 14 via the client computers 46,48 to, for example, retrieve and view archived digital video data generated by the cameras 32,34. As explained above, the network server computer 44 communicates with the client computers 46,48 via the network communications system 45 which may include, for example, the Internet, an intranet, a LAN, or a WAN.

Figure 2:
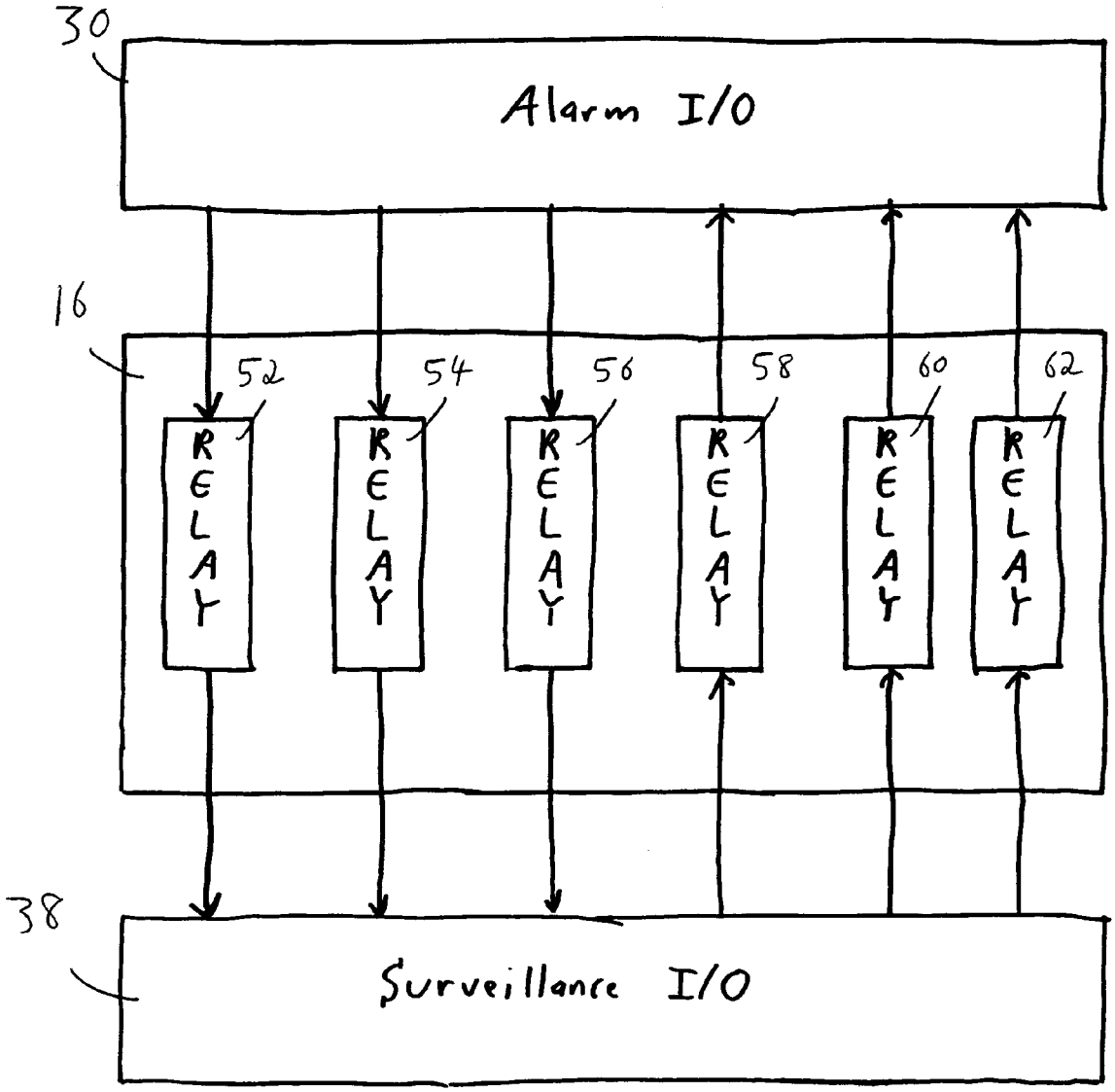
FIG. 2 is a detailed schematic view of an interface interposed between an alarm system and a surveillance system of the integrated system of FIG. 1.

Referring also to FIG. 2, the interface 16 is illustrated in greater detail. The interface 16 generally includes one or more electric circuits for receiving a signal from one of the alarm system 12 or the surveillance system 14 and retransmitting the signal to the other of the alarm system 12 or the surveillance system 14 in a format compatible with the receiving system. Such circuits may function, for example, by responding to a small current or voltage change by activating switches or other devices. The interface 16 may include a single circuit for one-way communication, may include a single circuit for two-way communication, or may include a plurality of circuits for one or two-way communication.

The illustrated embodiment of the interface 16 includes an array of electric relays 52,54,56,58,60,62, where three of the relays 52,54,56 are actuated by signals received from output ports of the alarm I/O module 30 and regulate voltage on input ports of the surveillance I/O module 38. Each of the remaining three relays 58,60,62 is actuated by a signal received from an output port of the surveillance I/O module 38 and regulate voltage on an input port of the alarm I/O module 30.

The present teachings contemplate configuring the alarm system 12, the surveillance system 14, or both to enable interaction between the two via the interface 16. According to a first implementation, the alarm system 12 is configured to inform the surveillance system 14 of a present state of the alarm system 12, such as armed, disarmed, triggered, and so forth. To do this, a signal from the alarm I/O module 30 may actuate a first relay 52 to assert a first signal if the alarm system 12 is armed, and de-assert the first signal if the alarm system 12 is disarmed; and may actuate a second relay 54 to assert a second signal if the alarm system 12 has been triggered.

If the surveillance system 14 determines that the alarm system 12 is not armed, the surveillance system 14 will not generate notifications of motion detected by the cameras 32,34. If the surveillance system 14 determines that the alarm system 12 is armed, the surveillance system 14 generates electronic notifications of motion detected by the cameras 32,34. Such notifications are communicated in a convention manner such as e-mail, voice mail, text messaging, paging, short messaging, and so forth.

Furthermore, if the surveillance system 14 determines that the alarm system 12 has been triggered, the surveillance system 14 can generate notifications of the triggered alarm. Thus, the integrated system 10 is operable to communicating electronic notifications in response to disturbances detected by both the alarm system 12 and the surveillance system 14, where such notifications are only sent when the alarm system is armed.

The alarm system 12 may be further configured to be reset via an input port of the I/O module 30. The surveillance system 14 may be set up to communicate an alarm reset signal to an input port of the alarm I/O module 30 via the interface 16. Software enabling communications between the surveillance system 14 and the network server computer 44 and the client computers 46,48 may be configured to allow a user to assert the alarm reset signal remotely from one of the client computers 46,48. According to this configuration, a user may reset the alarm system 12 remotely by clicking on a button of a user interface presented on a browser of one of the client computers 46,48.

In yet another example, the alarm system 12 may be configured to communicate information relating to a location of a sensor 18 or 20 that detected a disturbance. This may be done, for example, by connecting each of the sensors 18,20 directly to a relay of the interface 16 and configuring the surveillance system 14 to associate a signal received from each of the sensors 18,20 with a camera 32 or 34 that is located proximate the respective sensor 18,20. According to this configuration, the surveillance system 14 may communicate to a user which camera 32,34 corresponds to, or is most proximate, the disturbance detected by the alarm system 12. The user could then view video data generated by the identified camera and, according to the configuration discussed above, reset the alarm system 12 if the user determines that the disturbance was not a security breach. It will be appreciated that this configuration would supplement the ability of the surveillance system 14 to locate a disturbance by determining which camera 32,34 detected motion.

These are but a few examples, and it will be clear to one skilled in the art that the alarm system 12 and the surveillance system 14 may each be configured in any of a number of ways to complement the functionality of the other system.

Although the invention has been described with reference to the preferred embodiments illustrated in the attached drawings, it is noted that equivalents may be employed and substitutions made herein without departing from the scope of the invention as recited in the claims. It will be appreciated, for example, that the interface 16 may include any number of relays or similar circuits, that the alarm system 12 and surveillance system 14 may each be configured to communicate various pieces of information through a single relay.

Having thus described a preferred embodiment of the invention, what is claimed as new and desired to be protected by Letters Patent includes the following:

The invention claimed is:

1. A method of integrating an alarm system and a surveillance system comprising the steps of:

connecting an electric circuit to the alarm system and to the surveillance system such that the circuit receives a first signal from the alarm system in a first form and communicates the first signal to the surveillance system in a second form compatible with the surveillance system, and receives a second signal from the surveillance system in the second form and communicates the second signal to the alarm system in the first form compatible with the alarm system, wherein signals in the first form are incompatible with the surveillance system and signals in the second form are incompatible with the alarm system;

configuring the surveillance system to communicate an electronic notification in response to motion detected by a camera of the surveillance system if the first signal indicates that the alarm system is armed;

configuring the alarm system to deactivate an alarm in response to the second signal;

configuring the alarm system to communicate alarm status information via the first signal;

configuring the surveillance system to communicate alarm control information via the second signal;

configuring the surveillance system to associate a disturbance reported by the alarm system via the first signal with a camera of the surveillance system and to present video data generated by the camera to a user via a surveillance system monitor;

configuring the surveillance system to receive an alarm system reset signal from the user and generate the second signal in response to receiving the alarm system reset signal; and configuring the surveillance system to communicate video data to a remote computer and to receive an alarm system reset signal from the remote computer.

2. The method as set forth in claim 1, further comprising the step of connecting a first electric relay to the alarm system and the surveillance system as part of the electric circuit, such that the relay receives the first signal from the alarm system and communicates the first signal to the surveillance system.

3. An integrated alarm and surveillance system comprising:

an alarm system including— a user interface for enabling a user to arm and disarm the alarm system; and an input port for receiving an alarm system reset signal;

a surveillance system including— a video camera for detecting motion in a field of view of the camera, an input port for receiving an alarm system status signal indicating whether the alarm system is armed, and a controller for generating an electronic notification in response to detected motion if the alarm system is armed, and for generating an alarm system reset signal;

an interface including— a first electronic relay for receiving the status signal from the alarm system and communicating the status signal to the surveillance system in a form compatible with the input port of the surveillance system, and a second electronic relay for receiving the alarm system reset signal from the surveillance system and communicating the alarm system reset signal to the alarm system in a form compatible with the input port of the alarm system.

4. The integrated system as set forth in claim 3, wherein the surveillance system controller is adapted to communicate the electronic notification and video data generated by the camera to a remote computer, and to receive an alarm system reset signal from the remote computer.

* * * * *